US006311698B1

(12) United States Patent
Vaughn et al.

(10) Patent No.: US 6,311,698 B1
(45) Date of Patent: Nov. 6, 2001

(54) ANTI-DRIP HAIR STYLING DEVICE

(76) Inventors: Katia Vaughn; Patrizia Gonella, both of 11517 W. Olive Dr., Avondale, AZ (US) 85323

( * ) Notice: Subject to any disclaimer, the term of this patent is extended or adjusted under 35 U.S.C. 154(b) by 0 days.

(21) Appl. No.: 09/768,751

(22) Filed: Jan. 24, 2001

(51) Int. Cl.[7] ..... A45D 7/02

(52) U.S. Cl. ..... 132/212; 2/171; 2/918

(58) Field of Search ..... 132/212, 273, 132/274, 275, 202, 203, 204, 205, 206, 207, 270; 2/171, 181, 171.2, 209.13, 918, DIG. 11

(56) References Cited

U.S. PATENT DOCUMENTS 2,640,198 * 6/1953 Mullen ..... 2/174
3,050,071 * 8/1962 Hall ..... 132/212
4,368,545 * 1/1983 Seidman ..... 2/174
5,133,371 * 7/1992 Sivess ..... 132/212
5,647,061 * 7/1997 Marcus ..... 2/11
6,189,151 * 2/2001 Curtis ..... 2/171

* cited by examiner

*Primary Examiner*—Todd E. Manahan
*Assistant Examiner*—David Comstock
(74) *Attorney, Agent, or Firm*—Joseph N. Breaux

(57) ABSTRACT

An anti-drip device for use in hair styling to prevent hair treatment chemicals from running down on the forehead, neck and side of the user after having been applied to the hair and scalp area. The device includes a center section separated from two end portions by two ear indentations that are equally spaced from the center member. The device is, constructed from a polyester and polyamide micro-fiber material for super absorbency.

3 Claims, 4 Drawing Sheets

ANTI-DRIP HAIR STYLING DEVICE

TECHNICAL FIELD

The present invention relates to hair styling equipment and more particularly to an anti-drip device that is constructed from an absorbent material, such as a polyester and polyamide, micro-fiber material, having a center structure with two ear indentation portions equally spaced from a center member and two end portions; the center portion having a loop provided in connection therewith for securing around a perm rod or the like and to maintain the center structure of the device in the proper position; the ear indentation portions are provided for preventing pressure on the tops of the user's ears and the end portions are secured together to prevent dripping of hair perming solutions and the like down the face, ears, neck and back of the user during the hair treatment. The absorbent material may be a biodegradable, disposable paper material, such as is used for automobile and medical wipes, if desired.

BACKGROUND OF INVENTION

Many times while receiving hair treatments, chemical solutions are provided onto the hair which tend to run down the user's face, ears, neck and back causing unpleasant experiences such as burning eyes, skin irritation, etc. It would be desirable, therefore, to have an anti-drip device which could be wrapped around the forehead, ears and back of the user's neck which would prevent the dripping of these hair processing chemicals and eliminate the disadvantages of having these hair processing chemicals drip down the face, ears, neck, back and sides of the user's head.

SUMMARY OF INVENTION

It is thus an object of the invention to provide an anti-drip hair styling device that is constructed from a polyester and polyamide, micro-fiber material and having a center structure with two ear indentation portions equally spaced from a center member and two end portions; the center portion having a loop provided in connection therewith for securing around a perm rod or the like and to maintain the center structure of the device in the proper position especially during its placement; the ear indentation portions are provided for preventing pressure on the tops of the user's ears and the end portions are secured together to prevent dripping of hair perming solutions and the like down the neck and back of the user during the hair treatment.

Accordingly, an anti-drip hair styling device is provided. The anti-drip hair styling device is constructed from a polyester and polyamide, micro-fiber material and having a center structure two ear indentation portions equally spaced from a center member and two end portions; the center portion having a loop provided in connection therewith for securing around a perm rod or the like and to maintain the center structure of the device in the proper position; the ear indentation portions are provided for preventing pressure on the tops of the user's ears and the end portions are secured together to prevent dripping of hair perming solutions and the like down the face, ears, neck and back of the user during the hair treatment.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY EMBODIMENTS

Figure 1:
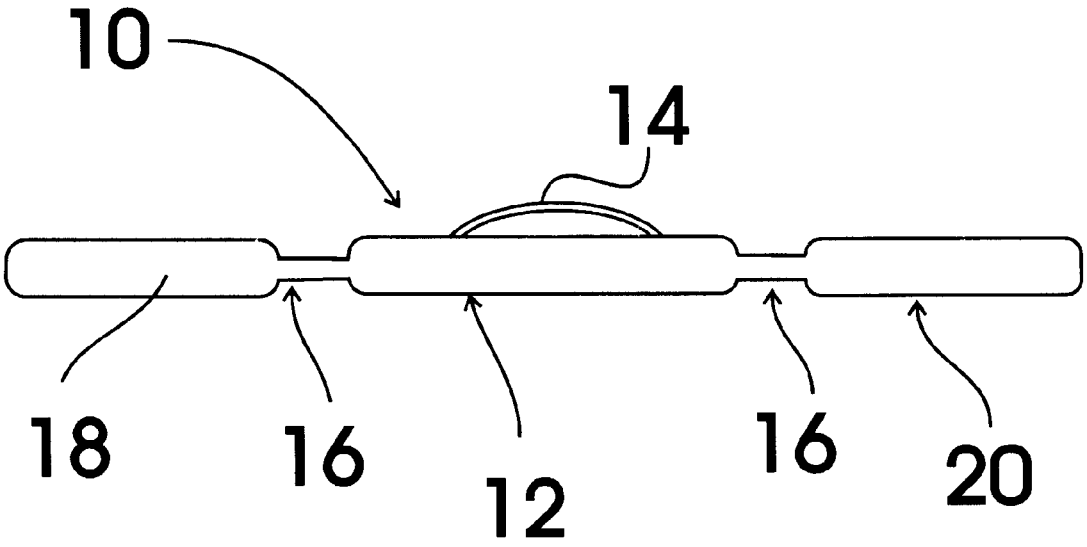
FIG. 1 is a front plan view of an exemplary embodiment of the device of the present invention.
Figure 3:
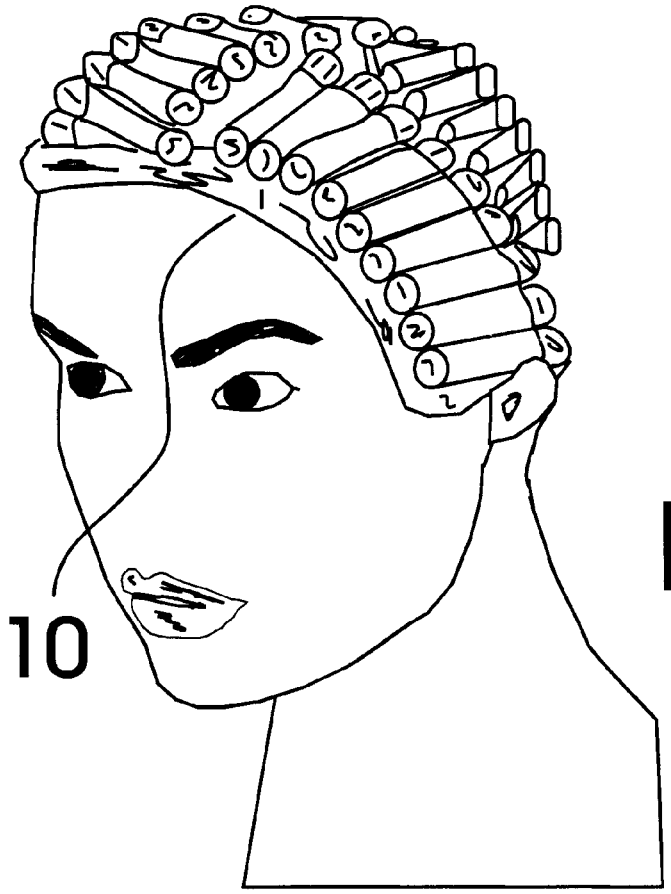
FIG. 3 is a perspective view of the exemplary device installed around the head of the user.
Figure 2:
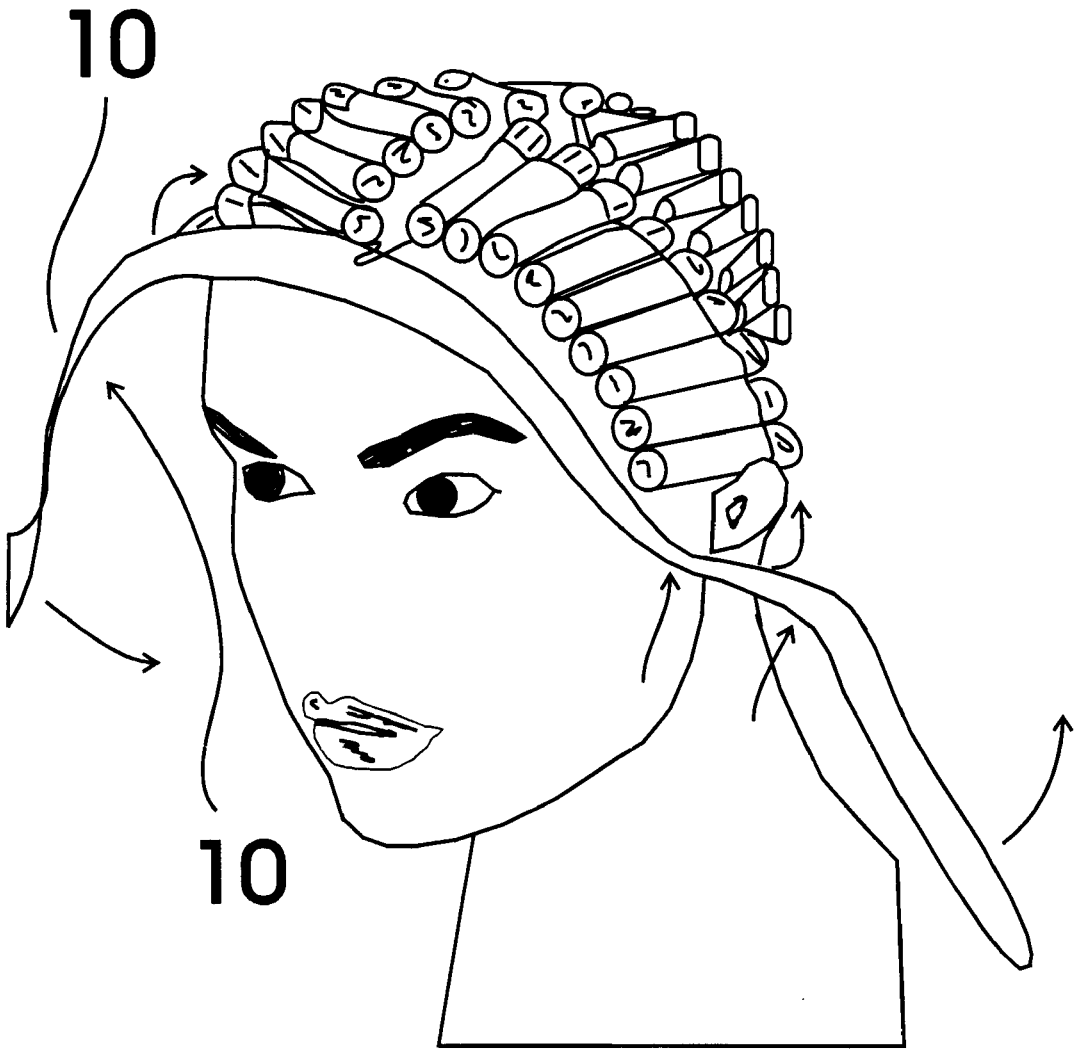
FIG. 2 shows the device of the present invention positioned in front of the head of a user.
Figure 4:
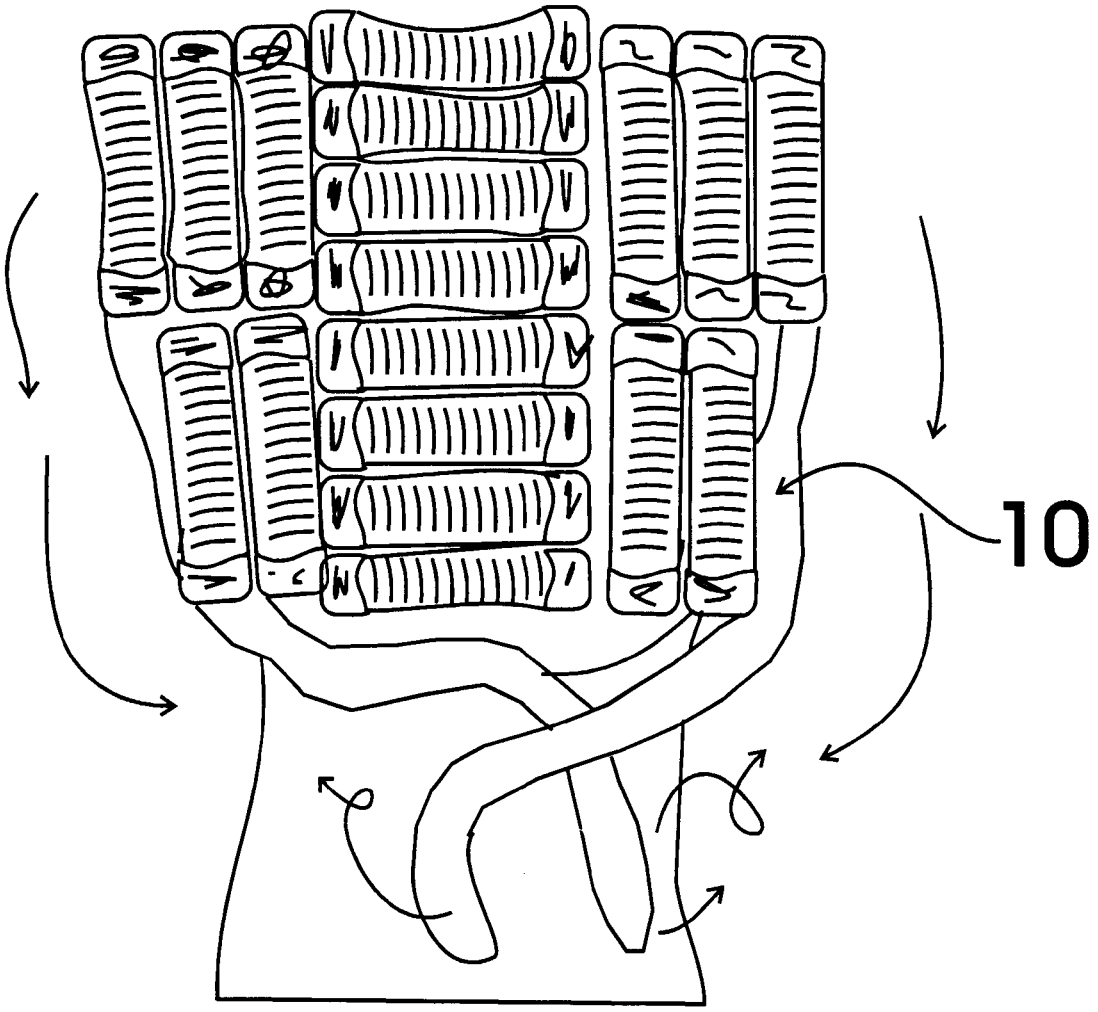
FIG. 4 shows the ends of the device being wrapped together to form a connection.
Figure 5:
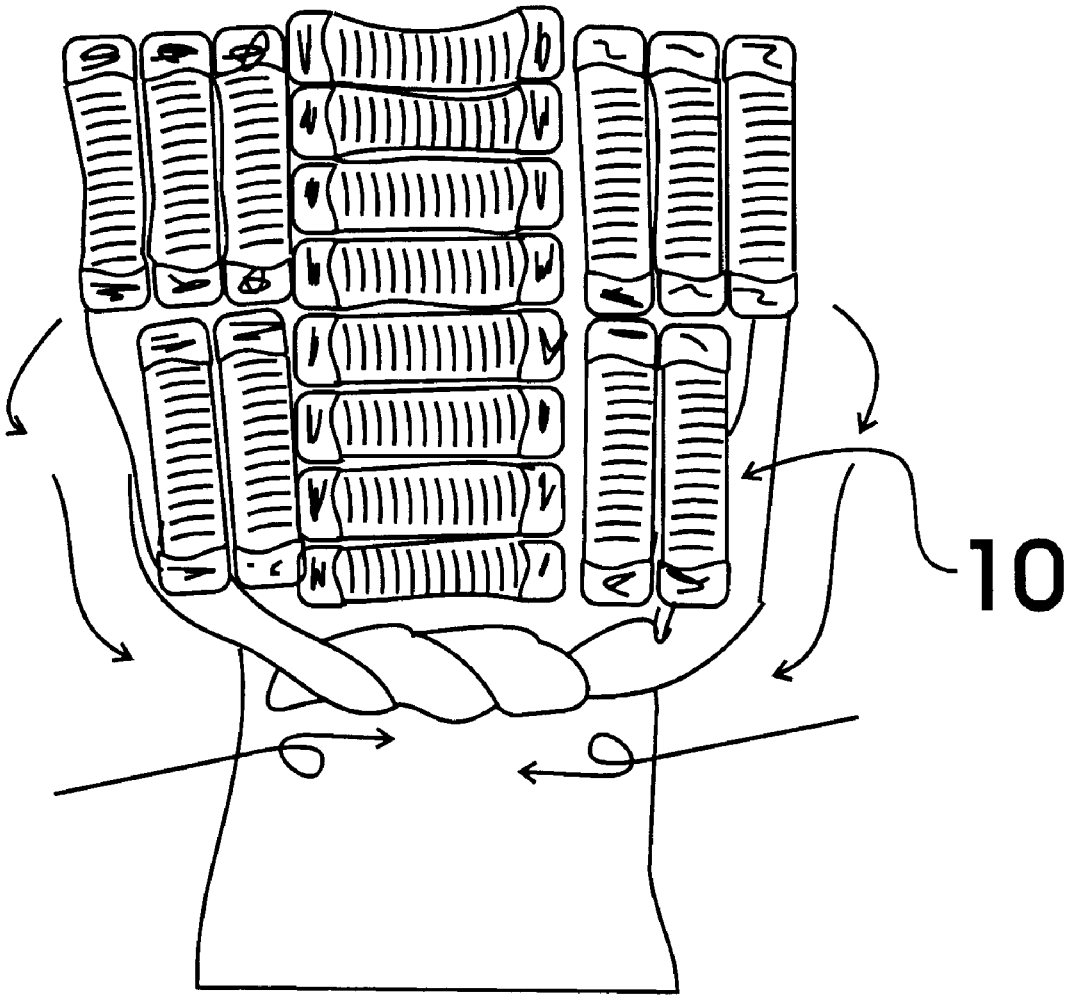
FIG. 5 shows the connection after it has been made by twisting the end sections into a twisted pair.

FIGS. 1 through 5 show various aspects of an exemplary embodiment of the anti-drip hair styling device of the present invention generally designated 10. Anti-drip hair styling device 10 is constructed from a polyester and polyamide micro-fiber material. Anti-drip hair styling device 10 includes a center structure generally designated 12 and having a loop 14 extending from the side thereof for securing the center section to a perm rod or the like to maintain center section 12 in the proper position during use. Ear indentation portions 14, 16 are provided on either side of center portion 16 and end portions 18 and 20 are provided on the opposite ends of each of the ear indentation portions 14, 16 respectively. In use, the user places center portion across the forehead of the user and secures the loop in position over a perm rod or the like if desired then wraps the remainder of the anti-drip hair styling device around the face of the user including around the ears and the back of the neck then twists the end portions 18, 20 around each other so that the anti-drip hair styling device is maintained in place to prevent dripping of hair treatment chemicals over the face, ears, back and neck of the person receiving the hair treatment.

It can be seen from the preceding description that an anti-drip hair styling device has been provided It is noted that the embodiment of the anti-drip hair styling device described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An anti-drip hair styling device comprising:

an absorbent material member having a center structure with two ear indentation portions equally spaced from a center portion and two end portions;

the center portion having a loop provided in connection therewith for securing the center portion to a perm rod by positioning the loop around the perm rod to maintain the center portion in the proper position particularly during the securing of the other portions of the absorbent material member;

the ear indentation portions each being provided for preventing pressure on the top of the user's ears;

the end portions being securable together in a manner to prevent dripping of hair treatment solutions down the face, ears, neck and back of the user during a hair treatment session.

2. The anti-drip hair styling device of claim 1, wherein:

the absorbent material member is constructed from a polyester and polyamide micro-fiber material.

3. The anti-drip hair styling device of claim 1, wherein:

the absorbent material member is constructed from a biodegradable, disposable paper material.

* * * * *